US006866542B2

(12) United States Patent
Murayama

(10) Patent No.: US 6,866,542 B2
(45) Date of Patent: Mar. 15, 2005

(54) COMBINATION OF DEVICE AND RETAINER CLIP FOR RETAINING THE DEVICE THROUGH AN OPEN WINDOW IN PANEL

(75) Inventor: Ryusuke Murayama, Koganei (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/618,516

(22) Filed: Jul. 11, 2003

(65) Prior Publication Data

US 2004/0023549 A1 Feb. 5, 2004

(30) Foreign Application Priority Data

Aug. 5, 2002 (JP) ..... 2002-227475
Apr. 4, 2003 (JP) ..... 2003-101936

(51) Int. Cl.[7] ..... H01R 13/73
(52) U.S. Cl. ..... 439/565
(58) Field of Search ..... 439/550, 565

(56) References Cited

U.S. PATENT DOCUMENTS 4,812,133 A * 3/1989 Fleak et al. ..... 439/248
5,066,247 A * 11/1991 Watson ..... 439/565
6,471,543 B1 * 10/2002 Balcombe et al. ..... 439/565

FOREIGN PATENT DOCUMENTS

JP U 51-48701 11/1976
JP U 64-5384 1/1989
JP U HO4-135181 12/1992

* cited by examiner

*Primary Examiner*—Phuong Dinh
(74) *Attorney, Agent, or Firm*—Michael Best & Friedrich LLP

(57) ABSTRACT

A retainer clip is used for retaining a connector through an open window in a panel. The connector has a connecting portion and two engaging elements projecting in a first direction together through the open window of the panel in a direction perpendicular to the first direction. The retainer clip has an aperture through which the connecting portion and the engaging elements are projected together in a first position and are slidable in the first direction to a second position. The clip is provided with locking tabs engaging with engaging surfaces on the engaging elements to prevent the clip from falling off from the connector in the second direction. The clip is further provided with stoppers engaging with detent surfaces formed on the engaging elements to prevent the clip from easily restore from the second position to the first position. In an embodiment, the clip is formed with elastic finger elements extending from side edge of the aperture thereof and stoppers are formed on the extending ends of the finger elements. The retainer clip can have, in place of the aperture, a cut-away portion with three sides closed but one side open.

15 Claims, 23 Drawing Sheets

COMBINATION OF DEVICE AND RETAINER CLIP FOR RETAINING THE DEVICE THROUGH AN OPEN WINDOW IN PANEL

BACKGROUND OF THE INVENTION

This invention relates to mounting technique of a device such as an electrical connector or others through an open window in a panel such as a panel wall of a housing of an electronic apparatus.

In mounting an electrical connector through an open window in a panel, screws or bolts are usually used. A connecting portion is projected through the open window and screws are screwed into a connector body through the panel. The panel must often be formed with screw receiving holes adjacent the open window. In a connector having nuts fixedly mounted thereinto, bolts are driven into the nuts through the bolt-receiving holes formed in the panel.

In order to mount or remove the connector to or from the panel, it is necessary to use a screwdriver and it is troublesome and time-consuming task to drive the screwdriver In a different way, one of a connector and a panel is formed with projections and the other is formed with corresponding grooves or slits. The connector and panel are jointed to each other by fitting the projections to the grooves or slits. However, the connector cannot be mounted to a panel having no projections or grooves corresponding to the connector having the grooves or projections.

SUMMARY OF THE INVENTION

It is an object of this invention to provide a combination of an electrical device such as an electrical connector and a retaining clip by which a user can readily mount and remove the device through an open window in a panel.

According to this invention, there is provided a combination of an electrical device and a retainer clip for removably retaining the device on a panel through an open window in the panel by holding the panel between the device and the retainer clip. The device comprises a device body, a device projecting portion projecting from a front surface of the device body, and two engaging elements projecting from the front surface at both sides of the device projecting portion opposite to each other in a first direction. The panel is provided with the open window through which the device projecting portion and the engaging elements project in a second direction perpendicular to the first direction. The retainer clip is a plate member, which is larger than the open window and has a fitting space for receiving the device projecting portion and the two engaging elements together fit therethrough, the fitting space being defined by space edges comprising at least three first, second and third sides to thereby surround the device projecting portion and the two engaging elements together over at least three sides. The first and second sides extend in a third direction perpendicular to the first and the second directions outsides of the two engaging elements opposite to each other in the first direction. The third side extends in the first direction at one side of the device projecting portion in the third direction. The retainer clip has locking tabs projecting into the fitting space from the space edges of the fitting space in the plate member and in the same plane of the plate member for engaging with corresponding ones of the engaging elements of the device. The retainer clip is positioned on the panel at a first position where the retainer clip surrounds the device projecting portion and the engaging elements together and to hold the panel between the device body and the retainer clip.

The retainer clip is then slid in the first direction into a second position where the locking tabs engage with corresponding ones of the engaging elements to thereby prevent the retainer clip from moving to apart from the panel and the device in the second direction, whereby the electrical device is retained on the panel through the open window in the panel, while the panel is secured between the retainer clip and the device body.

In a preferred embodiment, the electrical device is an electrical connector comprising a connector body and a connecting portion as the device body and the device projecting portion.

In a preferred embodiment, at least one locking tab is provided with a stopper protrusion projecting from the locking tab. The corresponding one of the engaging elements is provided with a detent surface for engaging with the stopper protrusion when the retainer clip is slid into to the second position to prevent the retainer clip from moving from the second position oppositely in the first direction.

In another preferred embodiment, the locking tab having the stopper protrusion is formed as an elastic element in a form of a finger. The finger slightly projects into the opening from the opening edge and is bent and extends oppositely in the first direction. The stopper protrusion is formed in the vicinity of an extended end of the elastic finger element.

Now, embodiments of the this invention will be exemplarily described as to a combination of an electrical connector as an electrical device and a retainer, with reference to the annexed drawings.

DESCRIPTION OF PREFERRED EMBODIMENTS

Figure 1:
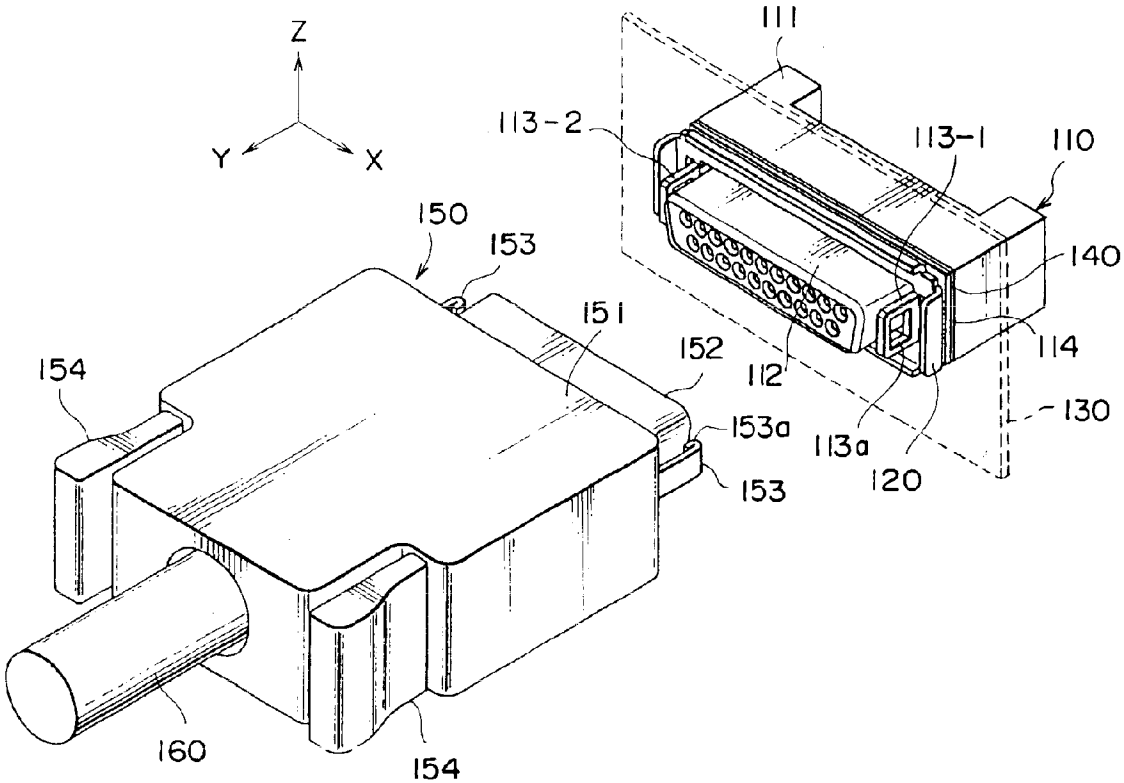
FIG. 1 is a perspective view illustrating a combination of an electric connector and a retainer clip according to an embodiment of this invention in a mounted condition on a panel, a mating connector being shown together.

Referring to FIG. 1, an interface connector 110, which is connected to an electric circuit (not shown) in an apparatus, is usually on a panel 130 such as a housing wall panel of the apparatus through an open window formed in the panel 130. The connector 110 comprises a connector body 111 having a front surface, a connecting portion 112 projecting from the front surface frontward and two latching members 113-1 and 113-2 also projecting in parallel to the connecting portion 112 from the front surface at both sides of the connecting portion 112 opposite to each other in a first direction or X-direction. Two latching members 113-1 and 113-2 will often collectively be represented by the same reference numeral "113". The connector 110 is usually provided with a metallic shell on the outer surface. The metallic shell is shown at 114. Each of the latching members 113 is provided with a latching hole 113*a*. A mating connector 150 is fixedly connected at an end of a cable 160 and is removably mated and connected with the connector 110. The mating connector 150 also comprises a mating connector body 151, a mating portion 152 projecting the mating connector body 151 and two locking members 153 projecting in parallel to the mating portion 152 from the connector body 151 at opposite sides of the mating portion 152 in the X-direction. Each of the locking members 153 is provided with a latching projection 153*a* at its free end when the mating portion 152 is mated with the connecting portion 112, each of the latching projections 153*a* can be engaged with the latching hole 113*a* of the corresponding one of the latching members 113 to thereby maintain the connection condition between the mating portion 152 and the connecting portion 112. Thus, the interface connector 110 and the mating connector 150 are maintained in the connected condition without unintended disconnection. Therefore, the electric circuit in the apparatus is electrically connected with the cable 160 through the interface connector 110 and the mating connector 150. When the mating connector 150 is disconnected from the interface connector 110, buttons 154, which are linked with the locking members 153, are operated to disengage the locking members 153 from the latching members 113. In the condition, the mating connector 150 can readily be removed from the interface connector 110.

This invention is directed to a structure retaining the connector 110 on the panel 130 using a retainer clip 120 cooperating with engaging portions formed on the latching members 113. A washer or gasket member 140 can be used if it is desired.

Now, referring to FIGS. 1–11B, description will be made in detail as to an embodiment of the mounting structure of the connector 110 on the panel 130 by use of the retainer clip 120.

Figures 2, 2A:
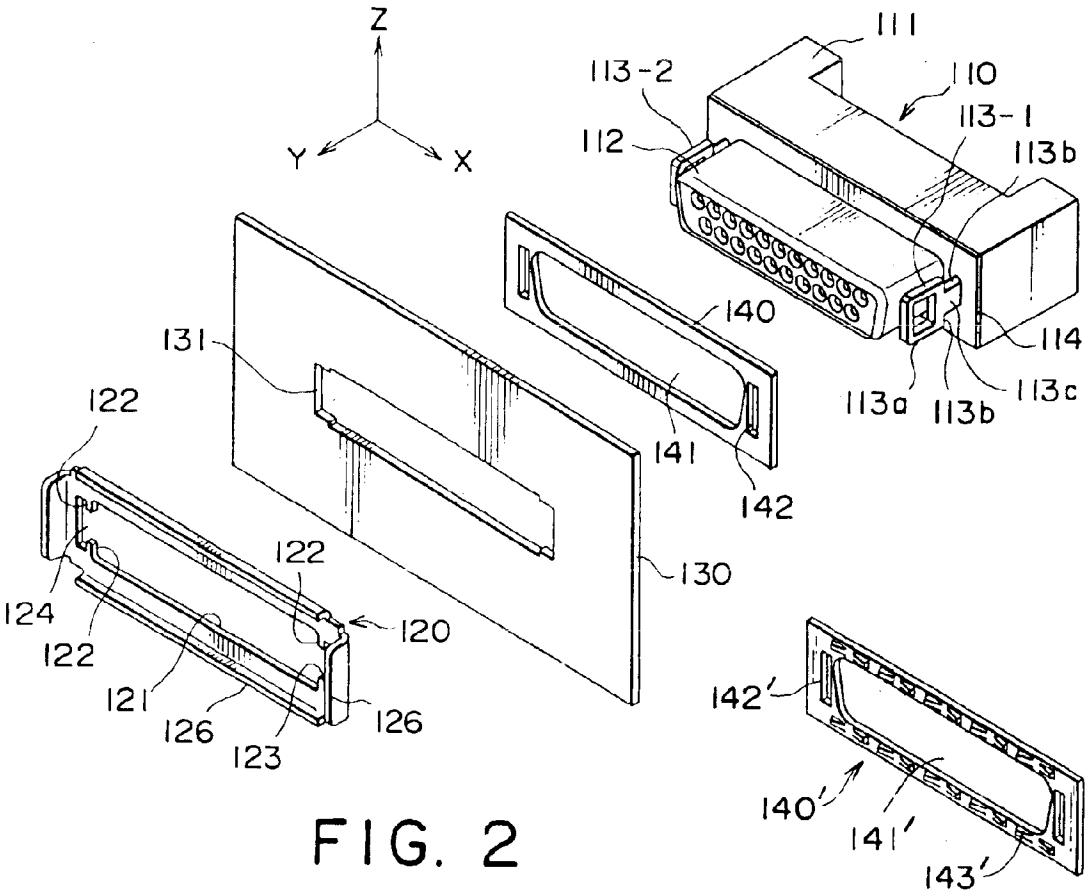
FIG. 2 is a perspective view illustrating a disassembled condition of the combination mounted on the panel in FIG. 1.

Referring to FIG. 2, the panel 130 is provided with an open window 131, through which the connecting portion 112 and latching members 113 project together from the rear side of the panel 130 frontward in a second or Y-direction perpendicular to the X-direction, as shown in FIG. 1. However, it should be noted that the open window 131 has an outer shape smaller than that of the front surface of the connector body 111. In the shown embodiment, the outer shape of the front surface of the connector body 111 is in a generally rectangular form elongated in the X-direction. Accordingly, the open window 131 is also shown in a generally rectangular form elongated in the X-direction.

In the interface connector 110, each of the latching members 113 is formed with two engaging portions or surfaces 113*b* for engaging with the retainer clip 120. The engaging surfaces 113*b* are positioned nearer to the front surface of the connector body 111 than the latching hole 113*a*. In detail, the latching member 113 comprises an upper portion and a lower portion in relation to the front surface of the connector body 111. The upper portion is provided with the latching hole 113*a* and the lower portion is smaller than the upper portion in the width or the dimension in a third direction or Z-direction perpendicular to the X-direction and the Y-direction. The lower portion is shown at 113*c* in the drawing. Accordingly, the latching member 113 has two surfaces, as the engaging surfaces 113*b*, facing the front surface of the connector body 111 at the boundary of the upper portion and the lower portion 113*c* at opposite sides in the Z-direction. The lower portion 113*c* is formed with detent surfaces (shown at 113*d* in FIGS. 7A, 7B, 10A and 10B) on the opposite surfaces in the Z-direction.

The retainer clip 120 is of a rectangular plate member having an aperture 121, which is also generally rectangular form elongated in the X-direction. The aperture 121 is similar to the open window 131 and is larger than that of the open window 131 in the panel 130 but smaller than the front surface of the connector body 111 in the X-direction. As is clearly shown in FIGS. 3A–3C, the aperture 121 serves as a fitting space for receiving the connecting portion 112 and the two latching members 113 together fit therethrough, as shown in FIG. 1. The aperture 121 as the fitting space is defined by aperture edges comprising first, second, third and fourth side portions 120*a*–120*d* to thereby surround the connecting portion 112 and the two latching members 113 together. The first and second side portions 120*a* and 120*b* extend in a third direction (Z) perpendicular to the first (X) and the second (Y) directions outsides of the two latching members 113 opposite to each other in the X-direction. The third and the fourth side portions extend in the X-direction at both sides of the connecting portion 112 opposite to each other in the Z-direction.

Figure 3B:
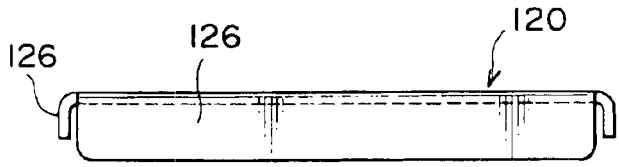
FIGS. 3A to 3C are a front, a plan and a side views of the retainer clip in FIG. 2.
Figure 3A:
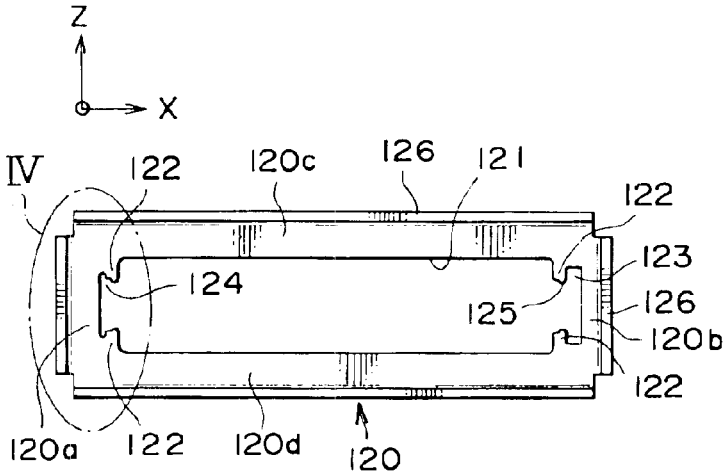
Figure 3C:
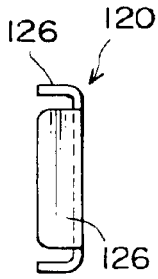
Figure 7A:
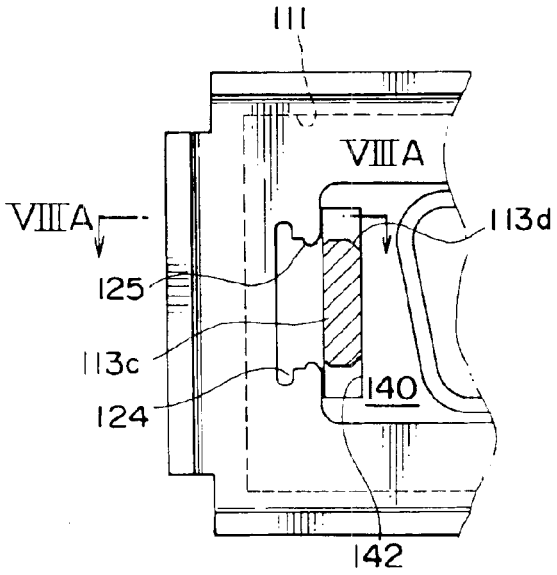
FIGS. 7A and 7B are enlarged views of different portions shown at VIIA and VIIB, respectively, in FIG. 6.
Figure 7B:
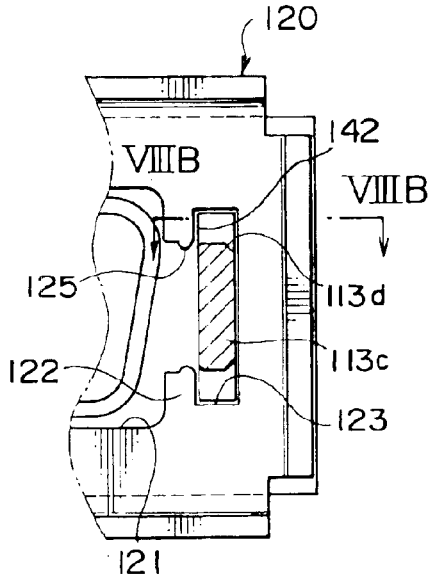
Figure 8A:
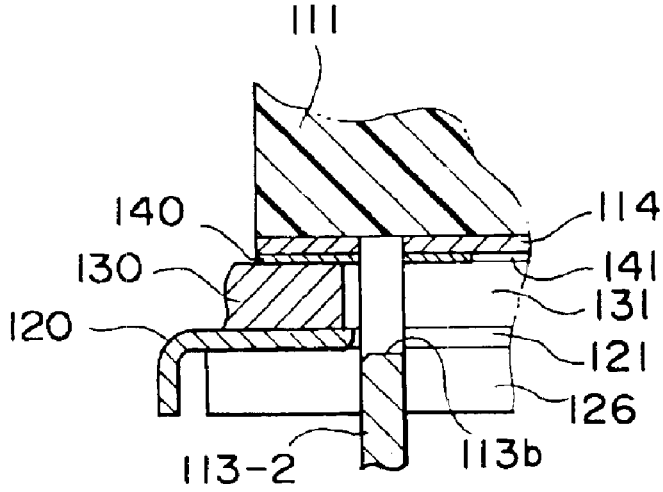
FIG. 8A is a sectional view taken along a line VIIIA—VIIIA in FIG. 7A.
Figure 8B:
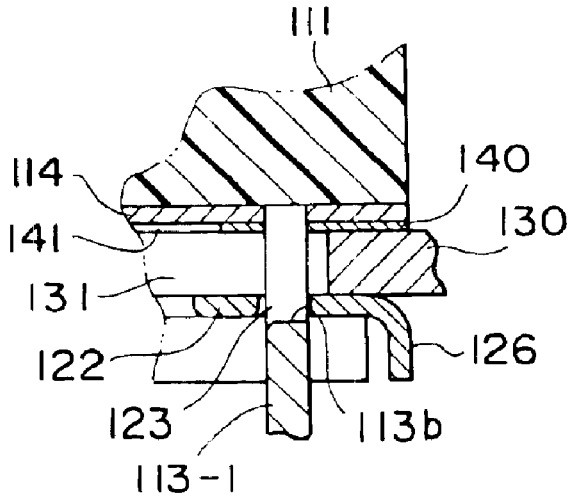
FIG. 8B is a sectional view taken along a line VIIIB—VIIIB in FIG. 7B.

As shown in FIGS. 2 and 3A, the retainer clip 120 is provided with four locking tabs 122, which extend into the aperture 121 and in the Z-direction from the edge of the aperture 121 at four different positions near the four corners of the rectangular aperture 121. At one end of the rectangular aperture 121 in the X-direction, there is left a slit 123 adjacent the second side portion 120*b*, that is, between the end edge of the aperture 121 and the locking tabs 122 near the two corners at the end. The slit 123 permits the corresponding one (113-1 in the shown embodiment) of the latching members 113 to pass therethrough, as shown in FIG. 7B. There is also left a small slit 124 adjacent the first side portion 120*a*, that is, between the opposite end of the aperture 121 and the other two locking tabs 122 near the corners at the end of the aperture. The small slit 124 is smaller than the slit 123 and does not permit the latching member 113 to pass therethrough. The small slit 124 is for relief in forming of the locking tabs 122 at the corners. This will be described hereinafter with respect to FIG. 5.

Figure 4:
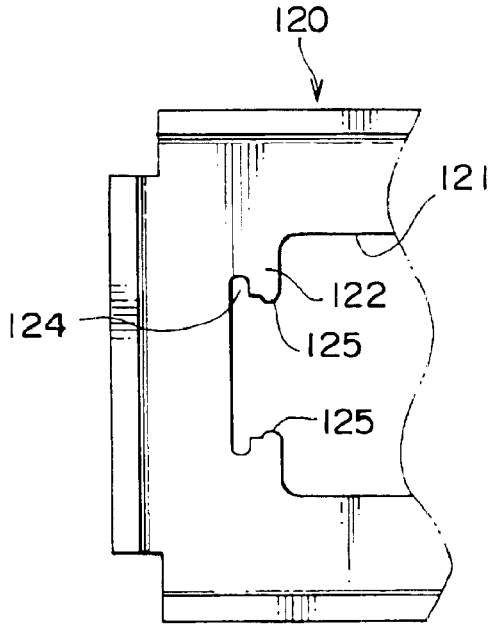
FIG. 4 is an enlarged view of a part of the retainer clip shown at IV in FIG. 3A.

Each of the locking tabs 123 is provided with a small projection 125, as a stopper projection or stopper protrusion, at an extending end of the locking tab 123. The stopper projection 125 further projects into the aperture in the Z-direction at a position slightly offset from a center of the locking tab 122 towards the slit 123 in the X-direction, as seen in FIGS. 4, 7A and 7B in addition to FIG. 3A. The stopper projection 125 is for engaging with the detent surface 113*d* of the latching member 113 when the clip 120 retains the connector 110, as will be described in detail hereinafter. In the present embodiment, the locking tab 122 and the stopper projection 126 are coplanar with the plate member of the retainer clip.

The retainer clip 120 is shown to have four flanges 126 bent at the four sides of the rectangular plate frontward in the Y-direction. The flanges 126 can be omitted as desired. Provision of one or more flanges can make the retainer clip easy in handling and improve the mechanical strength of the retainer clip.

In the present embodiment shown in FIGS. 1–11B, the washer 140 is used between the panel 130 and the front surface of the connector body 111. The washer 140 is a rectangular plate of a conductive and elastic material. The washer 140 has the same outer shape of the front surface of the connector body 111 and is formed with an aperture 141 having a shape similar to an outer shape of the connecting portion 112 of the connector 110 and two slits 142 each having a shape similar to an outer shape of the latching member 123, as viewed in Y-direction. Therefore, the connecting portion 112 and two latching members 113 can be inserted into the aperture 141 and two slits 142, respectively. Accordingly, the washer 140 can be brought into contact with the front surface of the connector body 111.

The washer 140 is used for improving the tightness between the panel 130 and the front surface of the connector body 111 in the condition where the connector 110 is retained by the retainer clip 120 through the open window 131 in the panel 130.

Alternatively, another washer 140' shown in FIG. 2A can be used in place of the washer 140. The washer 140' is also provided with apertures 141' and two slits 142' similar to those 142 in the washer 140 but is further provided with a plurality of elastic finger elements 143', so as to achieve the desired improvement of the tightness.

The use of any washer can be omitted if the tightness is insured between the panel 130 and the front surface of the connector body 111 sufficiently without use of the washer.

Use of the washer 140 or 140' made of a conductive and elastic material, for example, conductive rubber is desired for protection the connector from the electromagnetic interference (EMI).

Now, referring to FIGS. 6–11*b*, description will be made as to operation for retaining the connector 110 onto the panel 130 by use of the retainer clip 120.

At first, the washer 140 is mounted onto the connector 110 and then fitted to the panel 120 with the connecting portion 112 and the latching members 113 are inserted into the open window 131 in the panel 130 and are projected therethrough frontward in the Y-direction. Thereafter, the retainer clip 120 is fitted to the connector 110 by passing through the aperture 121 the connecting portion 112 and the latching members 113 together projecting through the open window 131 in the panel 130 and positioned in a first position where the retainer clip 120 is fitted with but does not yet retain the connector 110 while the panel 130 is held between the connector 110 and the retainer clip 120. In detail, one of the latching members 113-1 passes through the slit 123 between one end of the aperture 121 and a pair of locking tabs 122 adjacent the one end. The other latching member 113-2 passes through the aperture 121 in the vicinity of the other pair of locking tabs 123 adjacent the small slit 124 in the aperture 120, so that lower portions 113*c* of the latching members 113-2 are in the aperture slits 142 in the washer 140, in the open window 131 in the panel 130 and in the aperture 121 in the retainer clip 120. One of the lower portions 113*c* is in the slit 123 in the retainer clip 120 and the other lower portion 113*c* is adjacent the pair of locking tabs 122 adjacent the relief slits 124 in the aperture 121 in the panel 120 as shown in FIGS. 6–8B.

Figure 6:
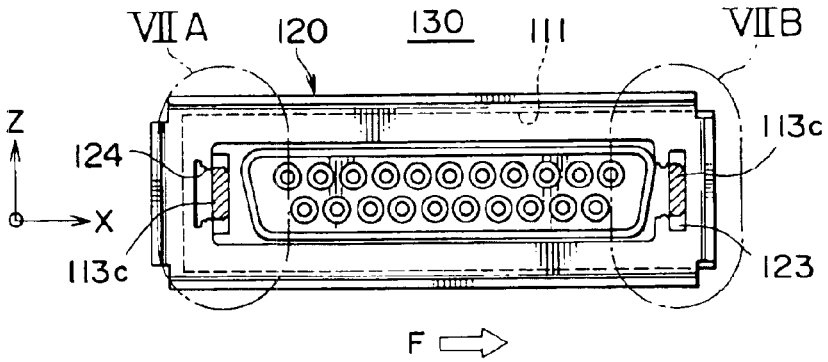
FIG. 6 is a front and partially sectional view illustrating a condition in which the retainer clip is positioned at a first position where it is fitted with but does not yet retain the connector while the panel is held between the connector and the retainer clip.

In FIGS. 6–7B, the latching members 113 are shown as the sectional views so as to show the relative positions of the lower portions 113*c* to the retainer clip 120.

Figure 9:
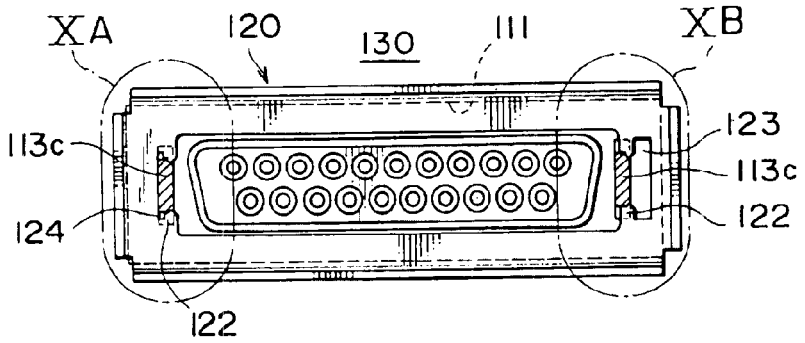
FIG. 9 is a front and partially sectional view illustrating another condition in which the retainer clip is positioned at a second position where it retains the connector with the panel being held between the connector and the retainer clip.
Figure 10A:
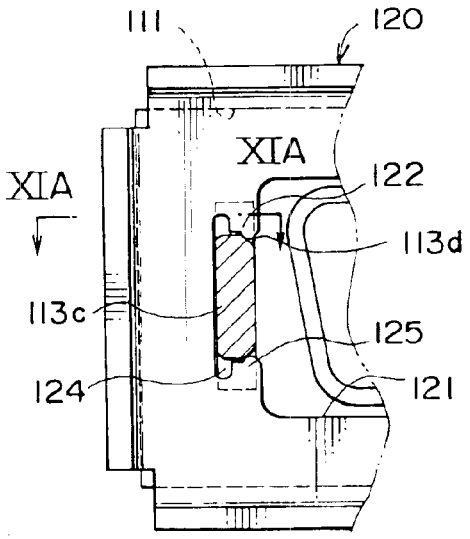
FIG. 10A is an enlarged view of a part shown at XA in FIG. 9.
Figure 10B:
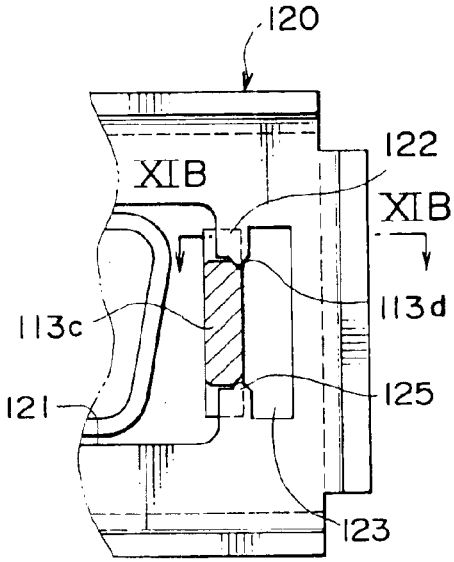
FIG. 10B is an enlarged view of another part shown at XB in FIG. 9.
Figure 11A:
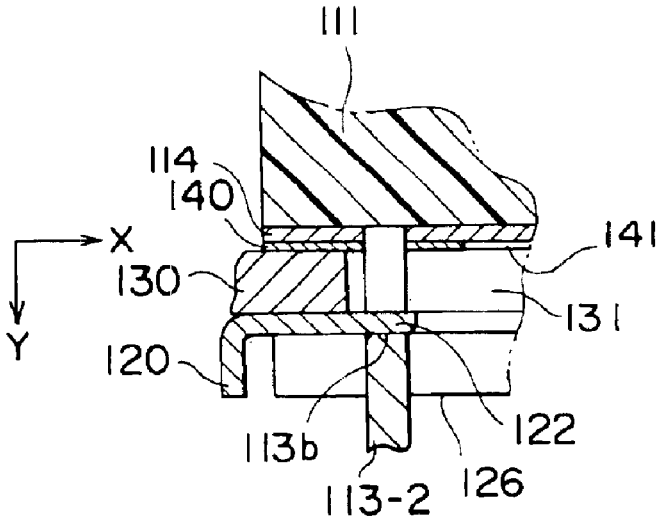
FIG. 11A is a sectional view taken along a line XIA—XIA in FIG. 10A.
Figure 11B:
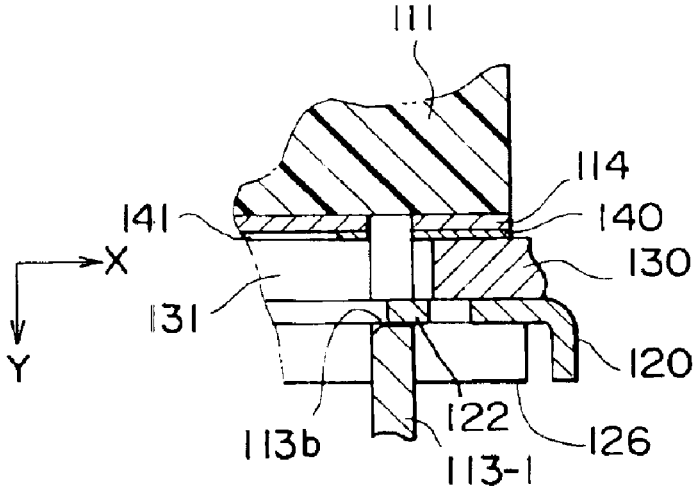
FIG. 11B is a sectional view taken along a line XIB—XIB in FIG. 10B.

Thereafter, the retainer clip 120 is moved in the X-direction or in a direction shown by a blank arrow F to a second position, as shown in FIG. 9, where the lower portion 113*c* of one of the latching members 113-1 relatively moves from the slit 123 into the aperture 121 beyond the stopper projections 125 of the pair of locking tabs 122 adjacent the slit 123 as shown in FIG. 10B with the locking tabs 122 being under the engaging surfaces 113*b*, as shown in FIG. 11B. The other lower portion 113*c* of the other latching member 113-2 is also relatively moved to the small relief slit 124 beyond the pair of stopper projections 125 of the other locking tabs 122 adjacent the relief slit 124, as shown in FIG. 10A with the other locking tabs 122 being under the engaging surfaces 113*b* of the other latching member 113 as shown in FIG. 11A.

Figure 5:
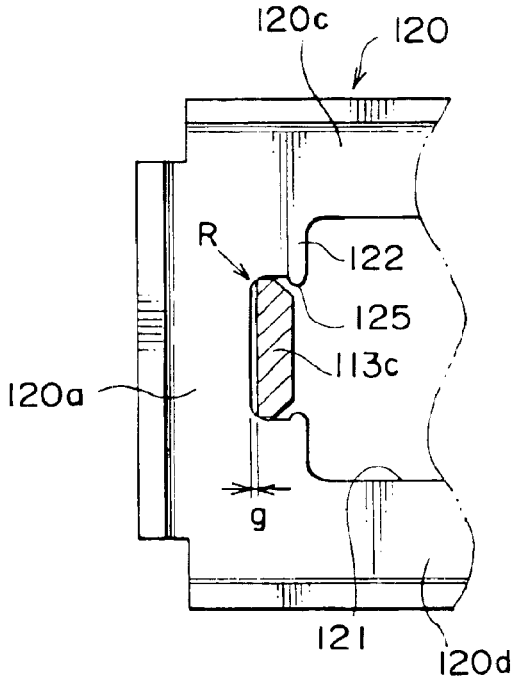
FIG. 5 is a view similar to FIG. 4, which shows an undesired design of the retainer clip.

In this connection, if the locking tabs 122 are formed at corners between the first side portion 120*a* and the third side portion 120*c* and between the first side portion 120*a* and the fourth side portion 120*d* without formation of the relief 124, as shown in FIG. 5, there is left a small round corner having a small curvature R at a connecting portion between the aperture edge of the first side portion 120*a* and each of the tab portions 122, when the aperture 121 is formed by punching a metal sheet. As a result, a small gap g is left between the aperture edge of the first side portion 120*a* and a side surface of the lower portion 113*c* of the latching member 113-2 when the retainer clip 120 is in the second position. Thus, the small round corner R suffers from repeated collision with the lower portion 113*c* during the repeated mounting operation of the connector 110 on the panel 130 by the retainer clip 120, so that the retainer clip 120 may unfortunately be cracked at the small round corner R.

In the second position, the retainer clip 120 is prevented from falling off from the connector 110 by engagement of the locking tabs 122 and the engaging surfaces 113*b* in the Y-direction. Thus, the connector 110 is retained by the retainer clip 120 on the panel 130 through the open window 131 in the panel 130.

Further, the engagement of the stopper projections 125 and the detent surfaces 113*d* on the sides of the lower portions 113*c* of the latching members 113 prevents the retainer clip 120 from moving to restore to the first position and maintains the retainer clip 120 in the second position.

When the connector 110 is desired to be removed from the panel 130, the retainer clip 120 is forcedly moved from the second condition shown in FIG. 9 to the first position shown in FIG. 6 in the X-direction or in the direction reversed to the blank arrow F in FIG. 6. As a result, the retainer clip 120 can be moved along the connecting portion 112 and the latching members 113 in the Y-direction and can be removed from the connector 110.

Figure 12:
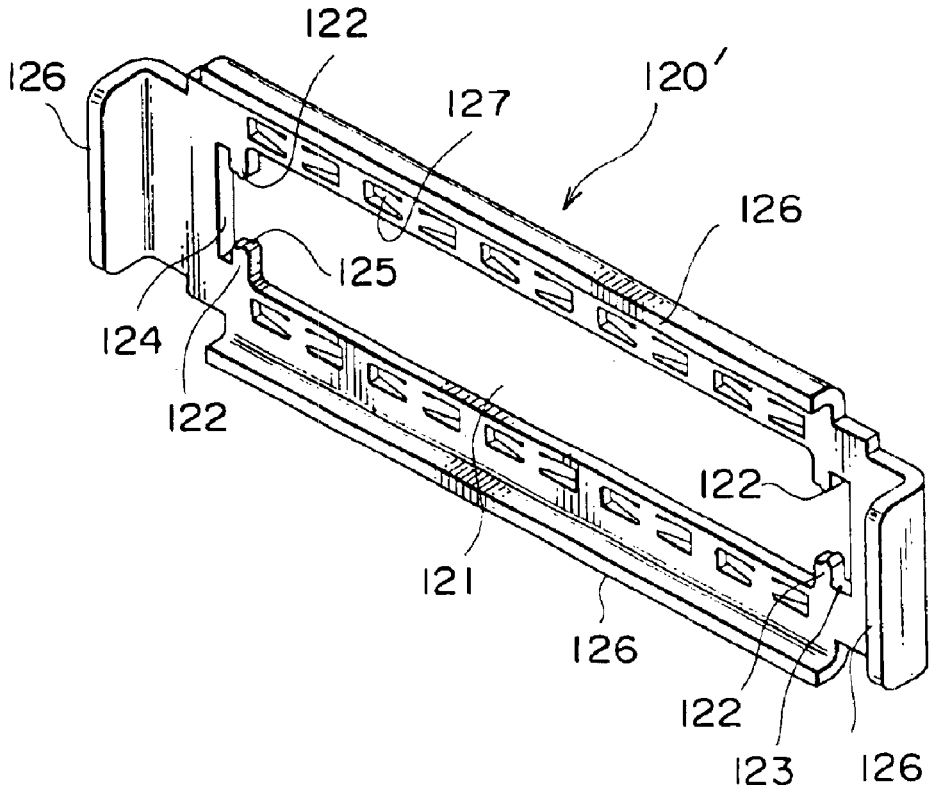
FIG. 12 is a perspective view of a retainer clip according to a modification.

Referring to FIG. 12, a retainer clip 120' shown therein is similar to, and a modification of, the clip 120 shown in FIGS. 1–11B. The similar portions are noted by the same reference numerals in retainer clip 120. The retainer clip 120' is only different from clip 120 in that it comprises a plurality of elastic fingers 127 around and along the aperture 121. Accordingly, the use of the retainer clip 120' can insure the tightness between the panel 130 and the front surface of the connector body 111 without use of the washer 140 in FIG. 2 or 140' in FIG. 2A.

Figure 13:
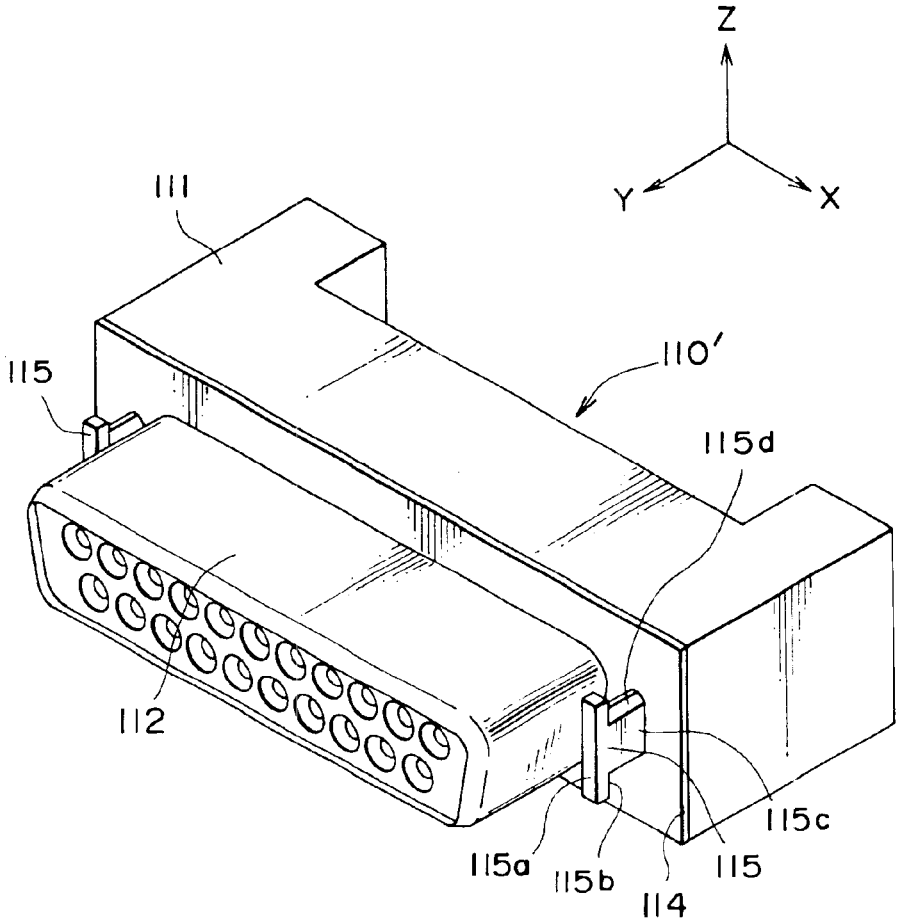
FIG. 13 is a perspective view of a connector according to another example.

Referring to FIG. 13, another connector 110' used in another embodiment of this invention is similar to the connector 110 shown in FIGS. 1–11B but is provided with only the engaging elements 115 in place of the latching members 113. In detail, each of the engaging elements 15 comprises an upper portion 115*a*, engaging surfaces 115*b*, a lower portion 115*c*, and detent surfaces 115*d* on the opposite sides of the lower portion 115*c*, which are corresponding to the upper portion, the engaging surfaces 113*b*, the lower portion 113*c*, and detent surfaces 113*d* of the latching member 113, respectively in the connector shown in FIGS. 1 and 2. However, each of the engaging elements 15 is not provided with any latching hole in the upper portion 15*a*. In FIG. 13, the other similar portion of the connector are represented by the same reference numerals in FIGS. 1 and 2 and are not described thereto.

The engaging elements 115 of the connector 110' co-operates with the retainer clip 120 or 120' to retain the connector 110' through the open window 131 in the panel 130 in the same manner as described above in connection with FIGS. 1–11B. However, since the connector 110' is not provided with the latching holes, it should be used together with a mating connector having no locking members, which is different from the mating connector 150 shown in FIG. 1.

Figure 14:
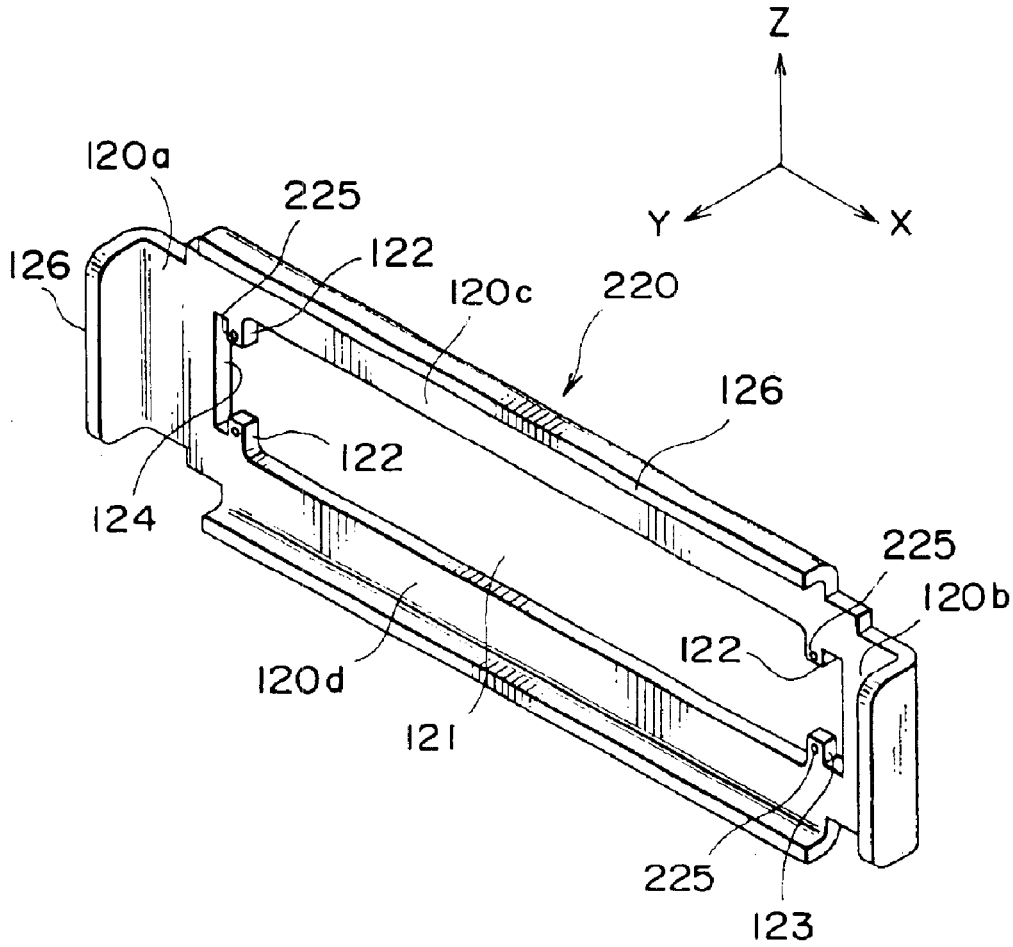
FIG. 14 is a retainer clip according to another embodiment.
Figure 15:
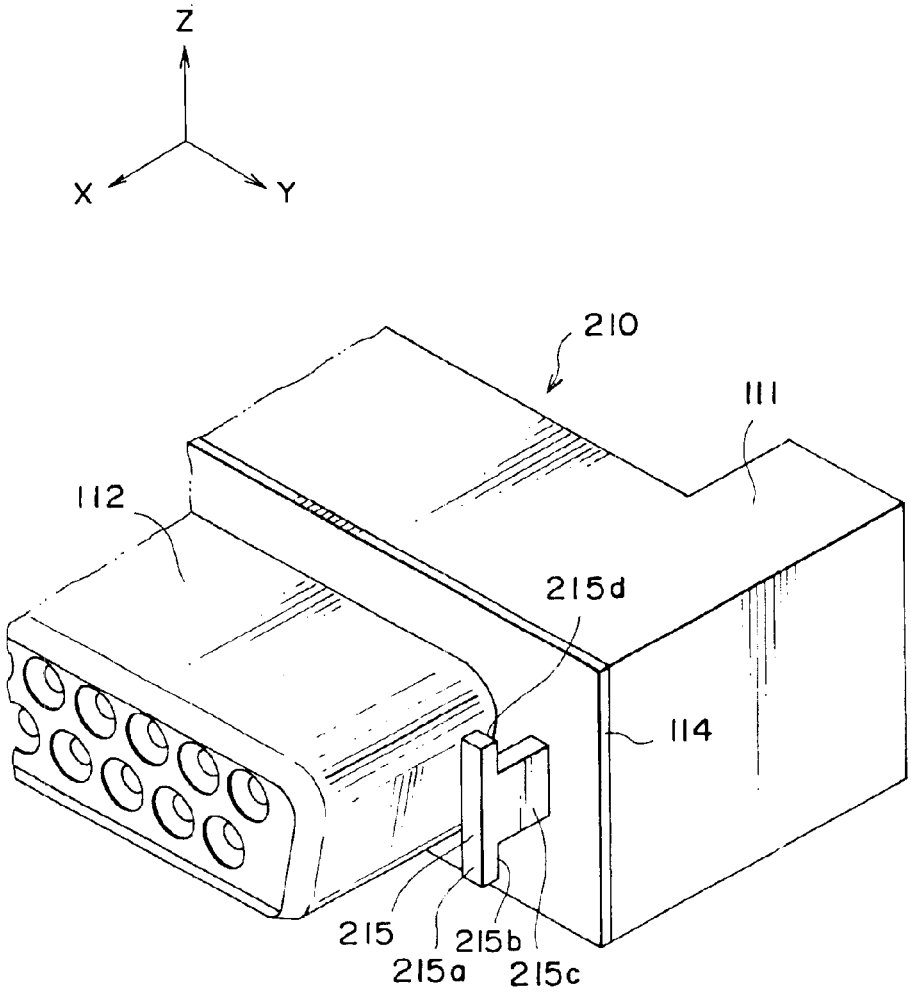
FIG. 15 is a perspective view partially showing a connector used together with the retainer clip shown in FIG. 14.

Next, referring to FIGS. 14–19B, another embodiment will be described, in which a retainer clip 220 in FIG. 14 is similar to the retainer clip 120 in FIGS. 1–11B except a difference in the projecting direction of stopper projections, while a connector 210 in FIG. 15 is similar to the connector 110' in FIG. 13 except a difference in places where the detent surfaces are formed. In FIGS. 14 and 15, the similar portions are represented by the same reference numerals as in FIGS. 3A–3B and FIG. 13.

In detail, each of the stopper projections project from each of the locking tabs 122 not into the aperture 121 in the retainer clip but in the Y-direction as shown at 225 in FIG. 14. Referring to FIG. 15, the connector 210 is similar to that shown in FIG. 13 except a structure of each of the engaging elements. The similar portions are represented by the same reference numerals in FIG. 13. The engaging element shown at 215 comprises an upper portion 215*a*, engaging surfaces 215*b* facing the front surface of the connector body 111, and a lower portion 215*c* projecting from the front surface of the connector body 111 and supporting the upper portion 215*a* thereon. Detent surfaces engaging with the stopper projections 225 are formed not on the opposite surfaces of the lower portion 215*c* in the Z-direction but on the engaging surfaces 215*b*, as shown at 215*d* in FIG. 15.

Figure 16:
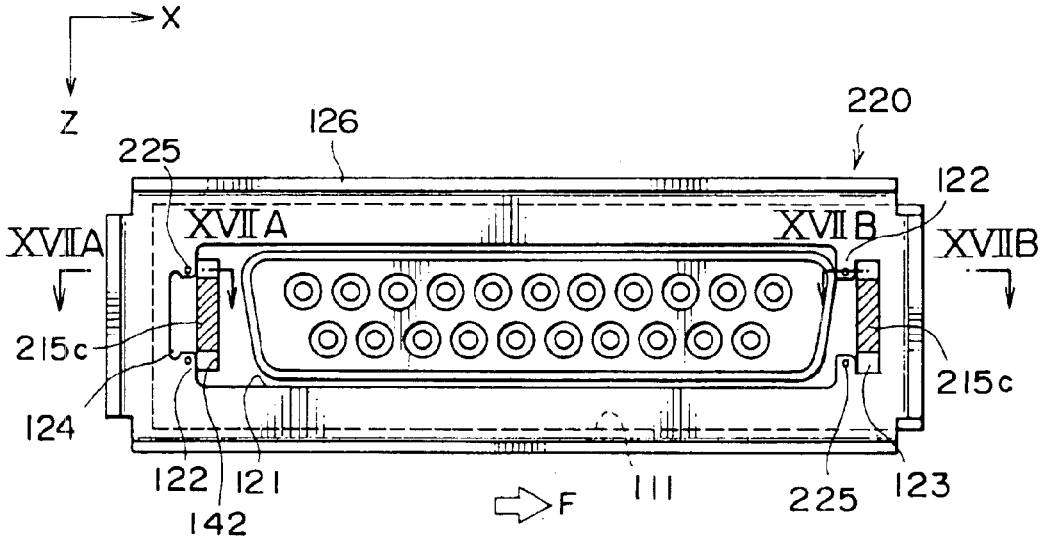
FIG. 16 is a front and partially sectioned view illustrating a combination of the retainer clip of FIG. 14 and the connector of FIG. 15 in a condition where the clip is positioned at the first position where the clip does not yet retain the connector.
Figure 17A:
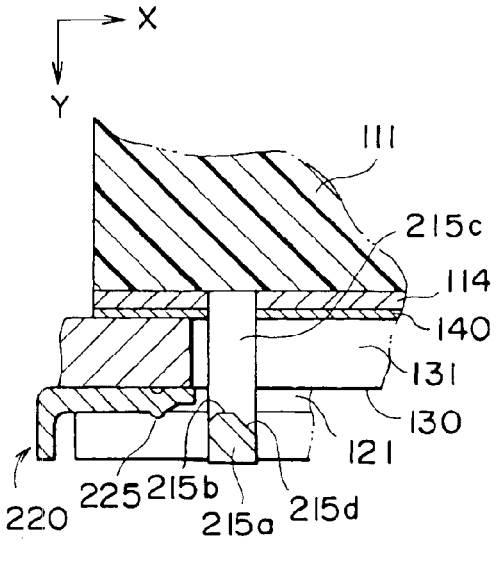
FIG. 17A is a sectional view taken along a line XVIIA—XVIIA in FIG. 16.
Figure 17B:
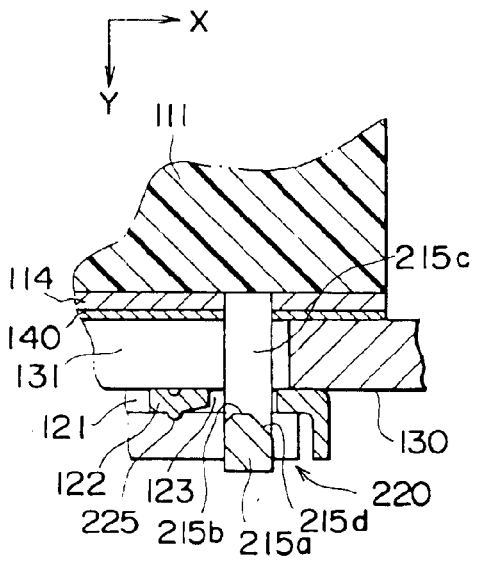
FIG. 17B is a sectional view taken along a line XVIIB—XVIIB in FIG. 16.

Referring to FIGS. 16–19B, description will be made as to operation for assembling the connector 210, the retainer clip 220 together with washer 140 (FIG. 2) on the panel 130 (FIG. 2). At first, the washer 140 is fitted onto the front surface of the connector body 111 of the connector 210 while the connecting portion 112 and the engaging elements 215 of the connector 210 are fitted through the aperture 141 and the slits 142 of the washer 140, respectively. Thereafter, the connecting portion 112 and the engaging elements 215 are projected frontward in the Y-direction through the open window 131 in the panel 130 and are then fitted through the aperture 121 in the retainer clip 220. In detail, one of the engaging elements 215 is fitted through the slit 123 while the connecting portion and the other engaging element 215 are fitted together into the aperture 121 between the four locking tabs 122, as shown in FIGS. 16, 17A and 17B. In FIG. 16, the engaging elements 215 are shown as sectional views for illustrating positional relation between the lower portions 215*c* and the aperture 121. The locking tabs 122 and the stopper projections 225 are offset from the engaging surfaces 215*b* and detent surfaces 215*d* in the X-direction as shown in FIGS. 17A and 17B. Thus, the retainer clip 220 is positioned at the first position where it does not yet retain the connector 210 through the open window 131 in the panel 130.

Figure 18:
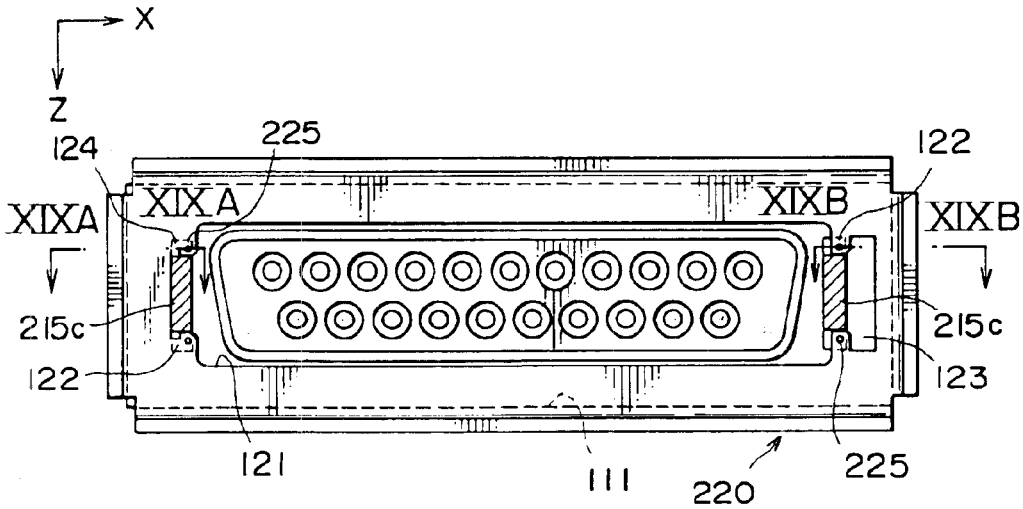
FIG. 18 is a front and partially sectioned view illustrating a combination of the retainer clip of FIG. 14 and the connector of FIG. 15 in a condition where the clip is positioned at the second position where the clip retains the connector.
Figure 19A:
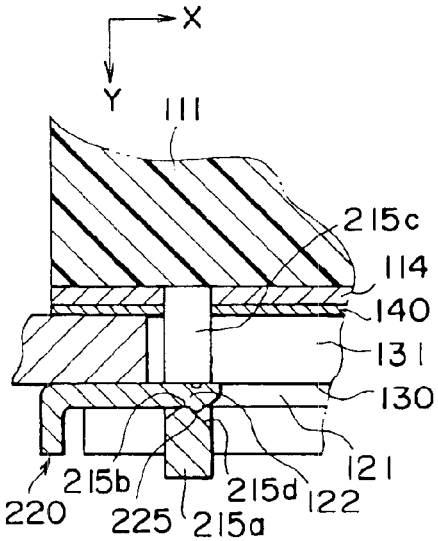
FIG. 19A is a sectional view taken along a line XVIIA—XVIIA in FIG. 16.
Figure 19B:
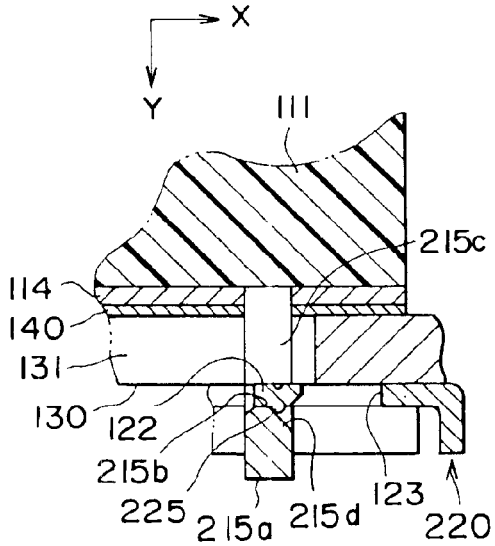
FIG. 19B is a sectional view taken along a line XVIIB—XVIIB in FIG. 16.

Thereafter, the retainer clip 220 is moved in the X-direction shown at a blank arrow F in FIG. 16 from the first position to the second position shown in FIG. 18, where the retainer clip 220 retains the connector 210 through the open window 131 in the panel 130. In detail, referring to FIGS. 19A and 19B in addition to FIG. 18, one of the lower portions 215*c* of the engaging elements 215 relatively moves from the slit 123 into the aperture 121 so that the stopper projections 225 go over the pair of engaging surfaces 215*b* of the engaging element 215 and engage with the detent surfaces 215*d* of the engaging element 225, while the engaging surfaces 215*b* engage with the locking tabs 122, as shown in FIG. 19B. The other pair of lower portions 215*c* of the engaging elements 215 relatively moves from the aperture 121 to the small relief slit 124 so that the stopper projections 225 adjacent the relief slit 124 go over the pair of engaging surfaces 215*b* of the engaging element 215 and engage with the detent surfaces 215*d* of the engaging element 225, while the engaging surfaces 215*b* engage with the locking tabs 122 adjacent the relief slit 124, as shown in FIG. 19A.

In the second position, the retainer clip 220 is prevented from falling off from the connector 210 by engagement of the locking tabs 122 with the engaging surfaces 215*b* and also by engagement of the stopper projections 225 with the detent surfaces 215*d*. Thus, the connector 210 is retained by the retainer clip 220 on the panel 130 through the open window 131 in the panel 130. The engagement of the stopper projections 225 with the detent surfaces 215*d* also prevents the retainer clip 220 from readily moving to restore to the first position and maintains the retainer clip 220 in the second position.

The connector 210 can be removed from the panel 130, if it is desired, by forcedly moving the retainer clip 220 from the second position shown in FIG. 18 to the first position shown in FIG. 16.

In the connector 110 shown in FIG. 2 having the latching members 113, the detent surfaces 113*d* may be formed on the engaging surfaces 113*b* in the similar form as in the connector 210 in FIG. 15. As a result, the connector 110 having the latching members can be retained on the panel 130 by use of the retainer clip 220 shown in FIG. 14.

Figure 20:
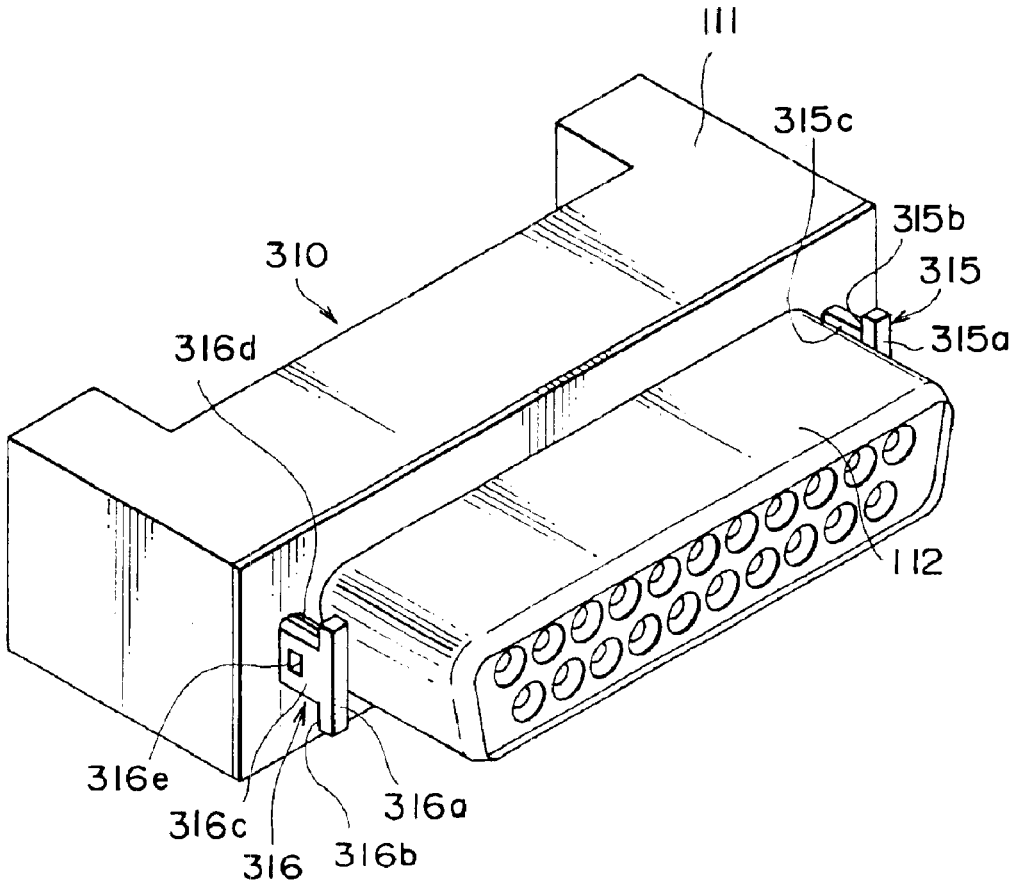
FIG. 20 is a perspective view of a connector according to a further embodiment.
Figure 21:
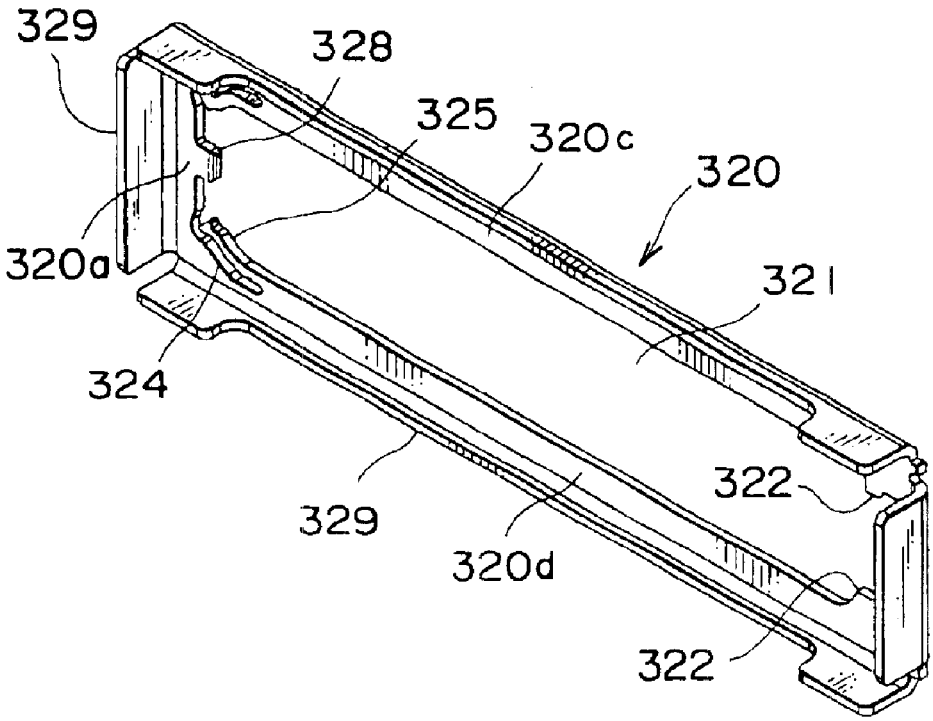
FIG. 21 is a perspective view of a retainer clip used together with the connector of FIG. 20.
Figure 22B:
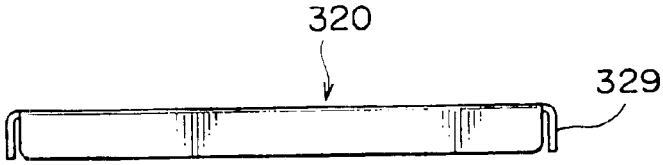
FIGS. 22A, 22B and 22C are a front, a plan and a side view of the clip of FIG. 21.
Figure 22A:
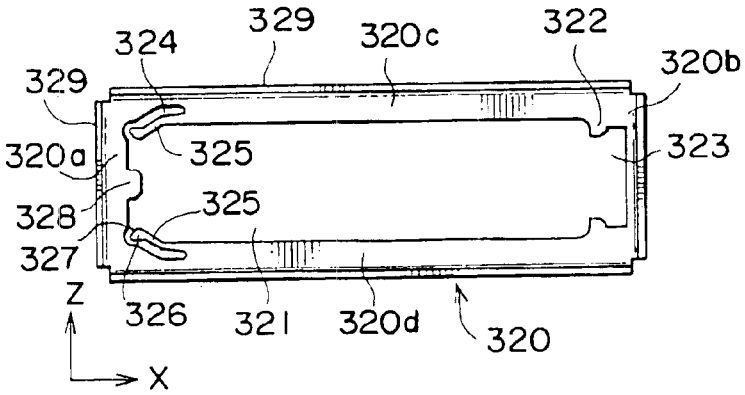
Figure 22C:
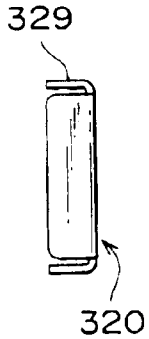

Referring to FIGS. 20–28B, another embodiment will be described. In the present embodiment, a connector 310 shown in FIG. 20 and a retainer clip 320 shown in FIGS. 21–22C are modifications of the connector 110' shown in FIG. 13 and the retainer clip 120 shown in FIGS. 3A–3C. The connector 320 is provided with two engaging elements 315 and 316 corresponding to those 115 of the connector 110'. The engaging element 315 is provided with upper portion 315*a*, engaging surfaces 315*b*, and lower portion 315*c*, which are corresponding to upper portion 115*a*, engaging surfaces 115*b*, and lower portion 115*c* of the engaging element 115 in FIG. 13. The engaging element 315 is provided with nothing corresponding to the detent surfaces 115*d* in the connector 110'. The other engaging element 316 is provided with upper portion 316*a*, engaging surfaces 316*b*, lower portion 316*c*, and detent surfaces 316*d* which are corresponding to upper portion 115*a*, engaging surfaces 115*b*, lower portion 115*c* and detent surfaces 115*d* of the engaging element 115 in the connector 110'. The engaging element 316 is further formed with a small hole 316*e* extending in X-direction in the lower portion 316*c*.

Referring to FIGS. 21–22C, the retainer clip 320 is similar to the retainer clip 120 shown in FIGS. 3A–3B except some differences in locking tabs and stopper projections. The retainer clip 320 is provided with a rectangular aperture 321 extending in the X-direction, which is defined by four side edges of first to fourth side portions 320*a*–320*d* similar to the first to fourth side portions 120*a*–120*d* in the retainer clip 120 in FIGS. 3A–3C. The retainer clip 320 has two locking tabs 322 in the vicinity of two corners between the second side portion 320*b* and the third side portion 320*c* and between the second side portion 320*b* and the fourth side portion 320*d*, and a slit 323 between the side edge of the second side portion 320*b*, which are corresponding to the locking tabs 122, and the slit 123 in the retainer clip 120. However, the locking tabs 322 are provided with no stopper projection and are therefore different from the locking tabs 122 of the retainer clip 120.

The locking tabs 322 are engaged with the engaging element 315 of the connector 310 in FIG. 20 by sliding the retainer clip 320 after the slit 323 receives the engaging element 315, when the retainer clip 320 is combined with the connector 310.

The retainer clip 320 is further formed with two small slits 324 extending from two corners between the first side portion 320*a* and the third side portion 320*c* in directions slightly inclined from X-direction and thereby formed two elastic finger portions 325. Each of the finger portions 325 has a free end adjacent the corner and is formed with a locking tab 326 at the free end. The locking tab 326 extends into the aperture 321 and has a stopper portion 327 at the extending end. The locking tab 326 and the stopper portion 327 engage with the engaging surface 316*b* and the detent surface 316*d*, respectively, of the engaging element 316 of the connector 310 in FIG. 10, by sliding the retainer clip 320 after the engaging element 316 is received in the aperture 321, when the retainer clip 320 is combined with the connector 310.

The retainer ring 320 is further formed with a locking projection 328 extending from a middle portion of the edge of the first side portion 320*a* in the X-direction. The locking projection 328 is fitted into the small hole 316*e* in the engaging element 316 when the retainer clip 320 is slid after the engaging element 316 is received in the aperture 321.

The description will be made as to operation for mounting the connector 310 shown in FIG. 20 onto the panel 130 shown in FIG. 2 by use of the retainer clip 310 shown in FIGS. 21–22*c* and the washer 140 shown in FIG. 2.

In the similar manner as described in the previous embodiments, the connector 310 is fit with the washer 140 and is fit to the retainer clip 320 by passing the connecting portion 112 and engaging elements 315 and 316 through the open window 131 and then aperture 321. The engaging element 315 is disposed in the slit 323 of the aperture 321 adjacent the locking tabs 322 while the other engaging element 316 is disposed adjacent the locking tabs 326 of the finger portions 325 in the aperture 321. Thus, the retainer clip 320 is positioned in the first position as shown in FIGS. 23, 24A and 24B, where the engagement elements 315 and 316 are shown in sectional views to illustrate lower portion

315*c* in the slit 323 and the small hole 316*e* of the lower portion 316*c* in the aperture 321.

Figure 23:
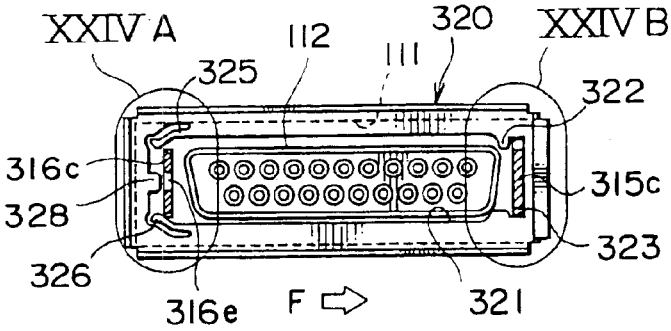
FIG. 23 is a front and partially sectioned view illustrating a combination of the retainer clip of FIGS. 21–22C and the connector of FIG. 20 in a condition where the clip is positioned at the first position where the clip does not yet retain the connector.
Figure 24A:
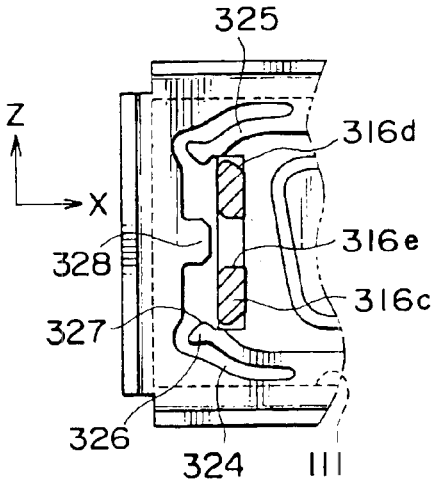
FIG. 24A is an enlarged view of a portion shown at XXIVA in FIG. 23.
Figure 24B:
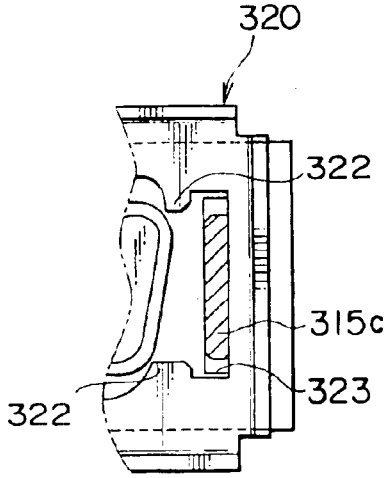
FIG. 24B is an enlarged view of another portion shown at XXIVB in FIG. 23.
Figure 25:
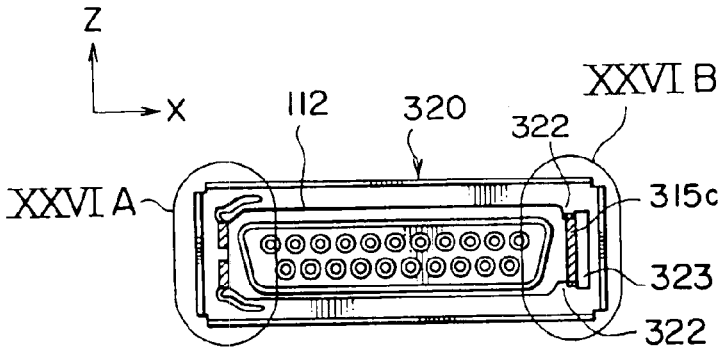
FIG. 25 is a front and partially sectioned view illustrating a combination of the retainer clip of FIGS. 21–22C and the connector of FIG. 20 in a condition where the clip is positioned at the second position where the clip retains the connector.
Figure 26A:
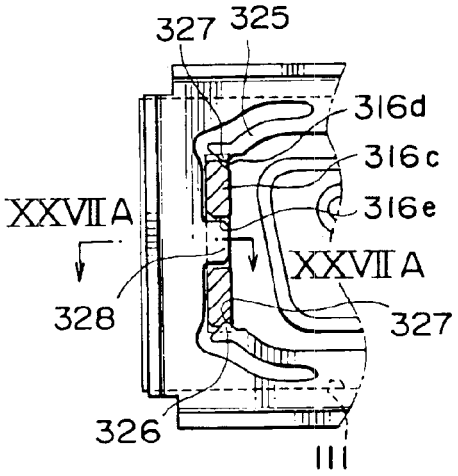
FIG. 26A is an enlarged view of a portion shown at XXVIA in FIG. 25.
Figure 26B:
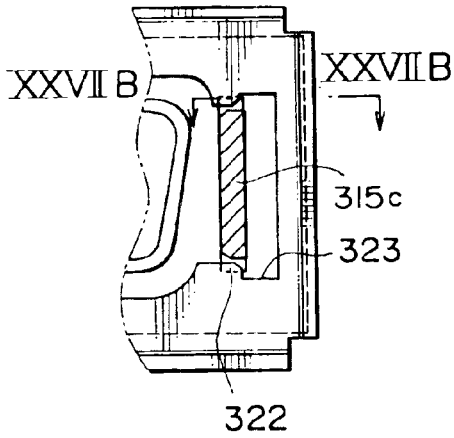
FIG. 26B is an enlarged view of a portion shown at XXVIB in FIG. 25.
Figure 27A:
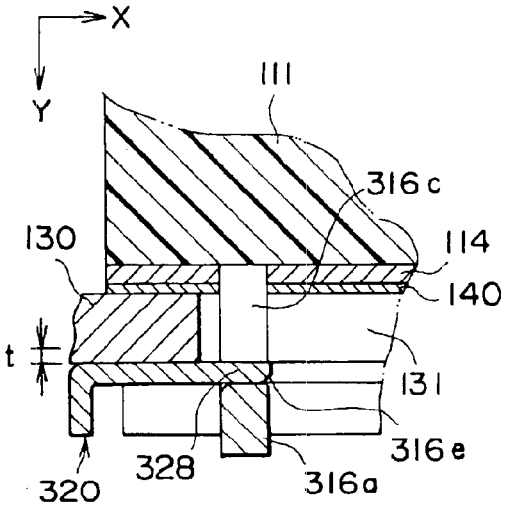
FIG. 27A is a sectional view taken along a line XXVIIA—XXVIIA in FIG. 26A.
Figure 27B:
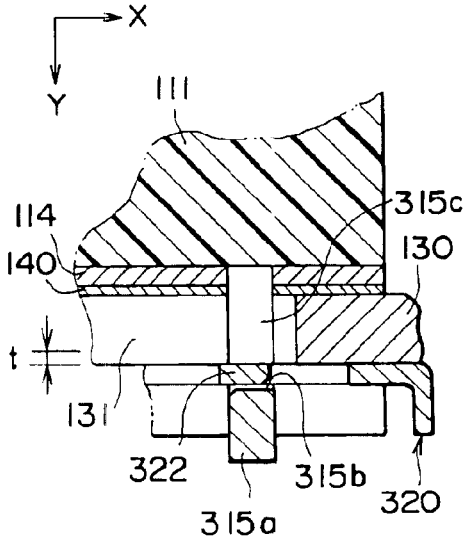
FIG. 27B is a sectional view taken along a line XXVIIB—XXVIIB in FIG. 26B.

Then, the retainer clip 320 is slid in the direction shown by a blank arrow F in FIG. 23 to the second position to shown at FIGS. 25–27B. In the second position, the lower portion 315*c* is moved from the slit 323 to a position between the locking tabs 322 as shown in FIGS. 25 and 26B, so that the locking tabs 322 are positioned under the engaging surfaces 315*b* in the Y-direction as shown in FIG. 27B.

On the other hand, stopper projections 327 go over the opposite sides of the lower portion 316*c* and come into engagement with the detent surfaces 316*d* and the locking projection 328 fits into the small hole 316*e* in the lower portion 316*c*, as shown in FIGS. 25, 26A and 27A.

Accordingly, the retainer clip 320 is prevented from falling off from the engaging elements 315 and 316 the Y-direction by engagement of the locking tabs 322 and the locking projection 328 with the engaging surfaces 315*b* and the small hole 316*e*, respectively, as well as engagement of the locking tabs 326 and the engaging surfaces 316*b* of the engaging element 316.

Since the engagement of the locking projection 328 with the small hole 326 is used, it can be possible to omit the engagement of the locking tabs 326 and the engaging surfaces 316*b* of the engaging element 316.

Further, the retainer clip 320 is prevented by the engagement of the stopper projections 327 and the detent surfaces 316*d* from easily sliding in the X-direction to restore the first position.

Figure 28A:
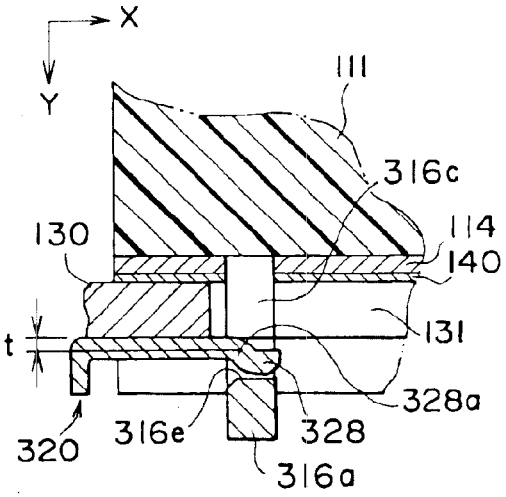
FIGS. 28A and 28B are sectional views similar to FIGS. 27A and 27B, in use of a modification of the clip of FIGS. 21–22C.
Figure 28B:
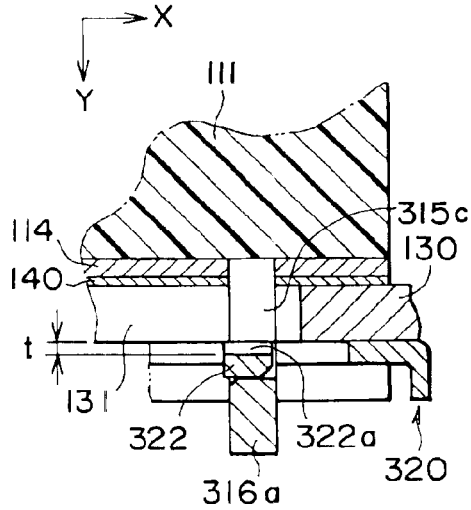

The retainer clip 320 shown in FIGS. 21–27B generally extends in a plane as a whole. However, the locking tabs 322 and the locking projection 328 can be formed with offset portions 322*a* and 328*a*, as shown in FIGS. 28A and 28B. In detail, each of the locking tabs 322 and the locking projection 328 can have a level difference "t" in the Y-direction between its end portion and the plane of the retainer clip 320. The formation of the offset portions 322*a* and 328*a* makes it possible to retain the connector 310 to different panels having different thickness by "t" or less. The difference of the thickness is shown at "t" in FIGS. 27A–28B.

Figure 29:
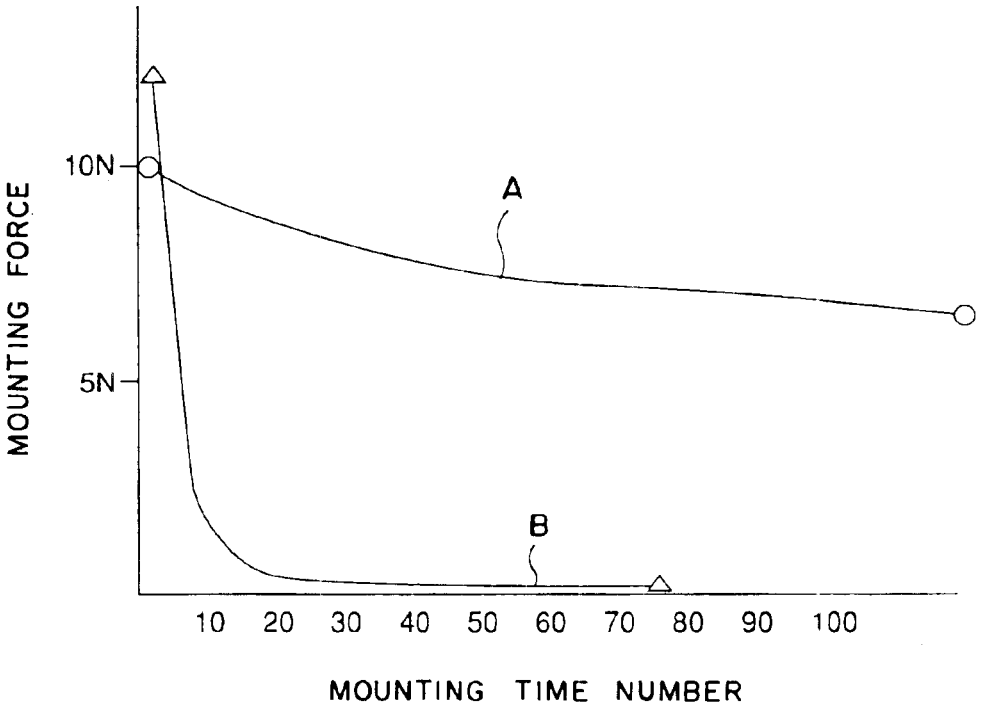
FIG. 29 is a graph illustrating a variation of a mounting force to a mounting time number of the retainer clip of FIGS. 21–22C comparing another retainer clip of FIGS. 3A–3C.

The retainer clip 320 shown in FIGS. 21–28B has elastic finger portions 325, on which the stopper projections 327 are formed. Accordingly, the elastic finger portions 325 elastically deform to enable the stopper projections 327 to smoothly go over the detent surfaces 316*d* when the retainer clip 320 is slid from the first position to the second position. Accordingly, the stopper projections 327 and the detent surfaces 316*d* are reduced in frictional wear and the force necessary for sliding the retainer clip 320 is not rapidly reduced even after 100 times repetition of attachment and dis-attachment of the connector by the retainer clip. This is more useful in comparison with the retainer clip 120 shown in previous embodiments. FIG. 29 shows test data of variation of the sliding force to the repetition mounting times. Curves A and B represent the variation in the use of the retainer clip 320 having the elastic finger portions 325 and in another use of the other retainer clip 120 without the elastic finger portion.

It will be understood by those skilled in the art that the connector 310 in this embodiment can have the latching holes on the engaging elements 315 and 316 in the similar manner as the connector 110 shown in FIGS. 1 and 2.

Figure 30:
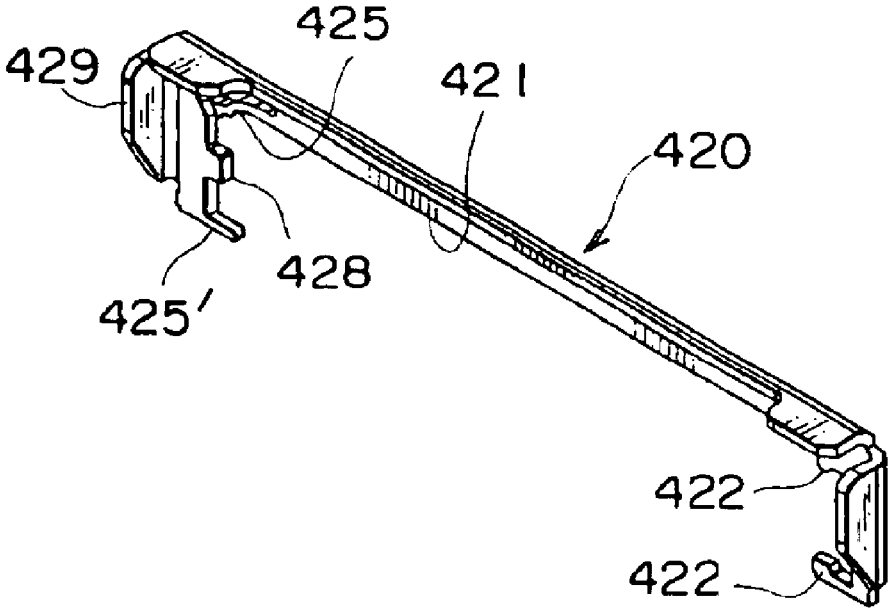
FIG. 30 is a perspective view of a retainer clip according to another embodiment.
Figure 31B:
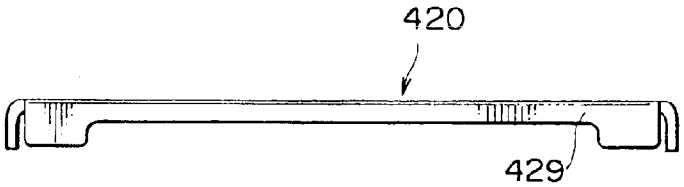
FIGS. 31A, 31*b* and 31C are a front, a plan and a side view of the retainer clip of FIG. 31.
Figure 31C:
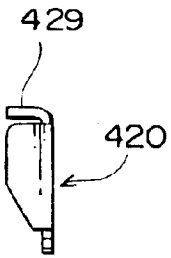
Figure 31A:
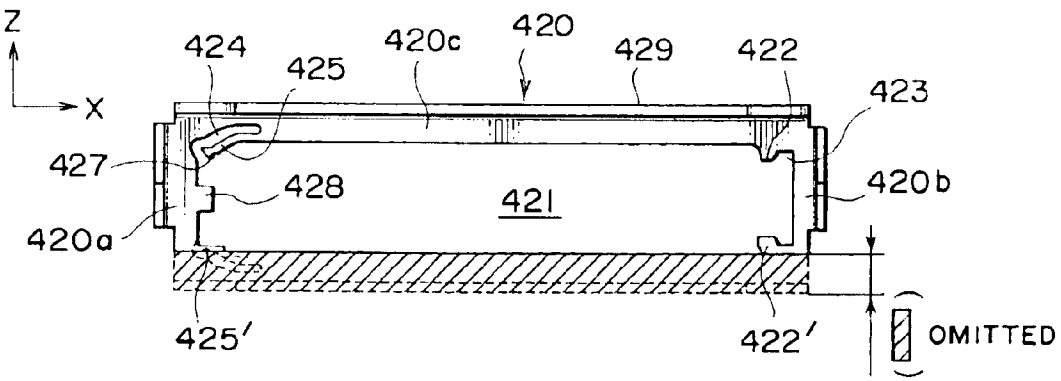

Referring to FIGS. 30–31C, there is shown a modification of the retainer clip 320. The modification retainer clip 420 is equivalent to a structure in which the fourth side portion of the retainer clip 320 is omitted as shown by hatching lines in FIG. 31A. A finger tab 425' is only formed, which slightly extends from a free end of the first side portion 420*a* in the X-direction.

As a whole, the retainer clip 420 comprises first to third side portions 420*a*, 420*b* and 420*c* defining a cut-away portion 421 as the fitting space corresponding to the aperture 321 of the retainer 320. The first and second side portions 420*a* and 420*b* define, and extend in the Z-direction at, the ends of the cut-away portion opposite to each other in the X-direction. The third side portion 420*c* defines, and extends in the X-direction, at the side of the cut-away portion 421. At one end of the cut-away portion, locking tabs 422 and 422' are formed extending from the third side portion 420*c* and the free end of the second side portion 420*b*, respectively, into the opening 421 and a slit 423 is left between the second side portion 423 and the locking tabs 422 and 422'. The slit 423 is corresponding to the slit 323 of the retainer clip 320, and the locking tabs 422 and 422' are corresponding to those 322 in the retainer clip 320.

At the opposite ends in the X-direction, the third side portion 420*c* is provided with a slit 424 extending from a corner between the first and third side portions 420*a* and 420*c* at the end of the opening in the X-direction to form an elastic finger element 425. At the extending end, the elastic finger element 425 has a stopper projection 427. The elastic finger element 425 and the stopper projection 427 are corresponding to the elastic finger element 325 and its stopper projection 327 in the retainer clip 320. At the free end of the first side portion 420*a*, the finger tab 425' projects in the X-direction. Further, the retainer clip 420 is formed with a locking projection 428 extending into the opening 421 in the X-direction from a middle portion of the edge of the first side portion 420*a* in the Z-direction. The locking projection 428 is corresponding to the locking projection 328 of the retainer clip 320.

The retainer clip 420 is also provided with four peripheral flanges 429 corresponding to flanges 326 of the retainer clip 320.

It will be noted that the retainer clip 420 can be used in the similar manner as the retainer clip 320, and that the former is useful in reduction of the weight and size.

What is claimed is:

1. A combination of an electrical device and a retainer clip for removably retaining the device on a panel through an open window in the panel by holding the panel between the device and the retainer clip, wherein the device comprises a device body, a device projecting portion projecting from a front surface of the device body, and two engaging elements projecting from the front surface at both sides of the device projecting portion opposite to each other in a first direction, wherein the panel is provided with the open window through which the device projecting portion and the engaging elements project in a second direction perpendicular to the first direction, and wherein the retainer clip is a plate member, which is larger than the open window and has a fitting space for receiving the device projecting portion and the two engaging elements together fit therethrough, the fitting space being defined by space edges comprising at least three first, second and third sides to thereby surround the device projecting portion and the two engaging elements together over at least three sides, the first and second sides extend in a third direction perpendicular to the first and the second directions outsides of the two engaging elements opposite to each other in the first direction, the third side extends in the first direction at one side of the device projecting portion in the third direction, and the retainer clip has locking tabs projecting into the fitting space from the space edges of the fitting space in the plate member and in the same plane of the plate member for engaging with corresponding ones of the engaging elements of the device, and wherein, in order to retain the device through the open window in the panel by the retainer clip, the retainer clip is positioned on the panel at a first position where the retainer clip surrounds the device projecting portion and the engaging elements together and to hold the panel between the device body and the retainer clip, and is then slid in the first direction into a second position where the locking tabs engage with corresponding ones of the engaging elements to thereby prevent the retainer clip from moving to apart from the panel and the device in the second direction, whereby the electrical device is retained on the panel through the open window in the panel, while the panel is secured between the retainer clip and the device body.

2. The combination as claimed in claim 1, wherein the electrical device is an electrical connector, which comprises a connector body and a connecting portion as the device body and the device projecting portion, respectively.

3. The combination as claimed in claim 2, wherein the connector is provided with latching members projecting from the front surface of the connector at both sides of the connecting portion in the first direction, each of the latching members is provided with the engaging elements (113*b*) and a latching hole for engaging with a corresponding one of locking members of a mating connector to maintain the connecting state between the connector and the mating connector.

4. The combination as claimed in claim 2, wherein the connector is provided with a metallic shell covering at lest the connecting portion and the front surface of the connector body.

5. The combination as claimed in claim 2, further comprising a washer, wherein the washer is used for retaining the connector in the open window in the panel by use of the retainer clip and held between the front surface of the connector body and the panel.

6. The combination as claimed in claim 5, wherein said washer is made of conductive and elastic material.

7. The combination as claimed in claim 2, wherein said retainer clip is provided with at least three peripheral flanges extending from outer peripheries of the at least three side portions in the second direction.

8. The combination as claimed in claim 2, wherein at least one of the locking tabs is provided with a stopper protrusion projecting from the locking tab, and the corresponding one of the engaging elements is provided with a detent surface for engaging with the stopper protrusion when the retainer clip is slid into to the second position to prevent the retainer clip from moving from the second position oppositely in the first direction.

9. The combination as claimed in claim 8, wherein the retainer clip comprises first, second, third and fourth side portions defining a rectangular aperture as the fitting space, the first and second side portions extending in parallel with each other in the third direction and the third and fourth side portions extending in parallel with each other in the first direction, wherein the retainer clip has first, second, third and fourth locking tabs formed in the vicinity of the four corners of the rectangular aperture, the first and the second locking tabs being formed at the two corners of the opposite ends of the first side portion, respectively, and the third and fourth locking tabs being formed at positions on the third and fourth side portions in the adjacent but apart from the corners of opposite ends of the second side portion, a slit being left in the aperture between the second side portion and the third and fourth locking tabs for receiving one of the engaging elements when the retainer clip is in the first position, and wherein at least one of the first through fourth locking tabs is provided with the stopper protrusion.

10. The combination as claimed in claim 9, wherein first through fourth locking tabs are provided with the stopper protrusions projecting into the aperture at the ends of the first through fourth locking tabs, respectively, the first through fourth locking tabs and the stopper protrusion are coplanar with the plate member, and wherein each of the engaging elements of the connector is provided with the detent surfaces at opposite sides thereof in the third direction.

11. The combination as claimed in claim 9, wherein the first through fourth locking tabs are provided with the stopper protrusions projecting in the second direction from the first through fourth locking tabs, and wherein each of the engaging elements of the connector is provided with the detent surfaces on the engaging surfaces.

12. The combination as claimed in claim 9, wherein first and second finger elements are formed and extend from the third and fourth side portions to slightly project into the aperture and are bent to extend towards the first side portion in the first direction, and the first and second locking tabs are formed on ends of first and second elastic finger elements, and wherein first and second stopper protrusions are formed in the vicinity of extended ends of the first and second elastic finger elements, respectively, and wherein one of the engaging elements of the connector is corresponding to the first and second stopper protrusions and is provided with the detent surfaces on the opposite sides in the third direction.

13. The combination as claimed in claim 12, wherein the one of the engaging elements corresponding to the first and second stopper protrusions is further provided with a locking hole extending therethrough in the first direction, and wherein the retainer clip is further provided with a locking projection extending in the first direction from an aperture edge of the first side portion, the locking projection fitting into the locking hole when the retainer clip is in the second condition.

14. The combination as claimed in claim 2, wherein the retainer clip comprises first, second and third side portions defining a cut-away portion as the fitting portion, the first and second side portions extending in the third direction (Z) and the third side portion extending in the first direction and bridging the first and second side portions, two lacking tabs being formed in the vicinity of the corner between the second and third side portions and at the free end of the second side portion, respectively, a slit being left in the cut-away portion between the two locking tabs and the second side portion for receiving one of the engaging element of the connector when the retainer clip is in the first position, and an elastic finger element is formed to extend toward the fist side portion from the third side portion in the first direction with slight bending, and a stopper protrusion is formed at an extended end of the elastic finger element, a finger tab extending from the free end of the first side portion in the first direction, and wherein one of the engaging elements of the connector is corresponding to the stopper protrusion and the finger tab and is provided with the detent surface to engage with the stopper protrusion when the retainer clip is in the second condition.

15. The combination as claimed in claim 14, wherein the one of the engaging elements corresponding to the stopper protrusions is further provided with a locking hole extending therethrough in the first direction, and wherein the retainer clip is further provided with a locking projection extending in the first direction from an edge of the first side portion, the locking projection fitting into the locking hole when the retainer clip is in the second condition.

* * * * *

UNITED STATES PATENT AND TRADEMARK OFFICE

CERTIFICATE OF CORRECTION

PATENT NO. : 6,866,542 B2
DATED : March 15, 2005
INVENTOR(S) : Ryusuke Murayama

It is certified that error appears in the above-identified patent and that said Letters Patent is hereby corrected as shown below:

Title page,
Item [57], ABSTRACT,
Line 14, delete “restore” and insert -- restoring --;

Column 1,
Line 22, insert -- . -- after “screwdriver”;

Column 2,
Line 4, delete “to”;
Lines 17 and 27, delete “the”;

Column 4,
Line 1, delete “31b” and insert -- 31B --;
Line 30, delete “end when” and insert -- end. When --;

Column 13,
Line 30, delete “lest” and insert -- least --;
Line 48, delete “to”;

Column 14,
Line 42, delete “lacking" and insert -- locking --;
Line 47, delete “element” and insert -- elements --; and
Line 49, delete “fist” and insert -- first --.

Signed and Sealed this

Thirtieth Day of August, 2005

JON W. DUDAS
*Director of the United States Patent and Trademark Office*